US009970129B2

(12) United States Patent
Nishimura et al.

(10) Patent No.: US 9,970,129 B2
(45) Date of Patent: May 15, 2018

(54) CONJUGATED FIBER, BASE BODY FOR ARTIFICIAL LEATHER, AND ARTIFICIAL LEATHER

(71) Applicant: TORAY INDUSTRIES, INC., Tokyo (JP)

(72) Inventors: Hajime Nishimura, Otsu (JP); Yukihiro Matsuzaki, Gifu (JP); Makoto Nishimura, Otsu (JP)

(73) Assignee: TORAY INDUSTRIES, INC., Tokyo (JP)

( * ) Notice: Subject to any disclaimer, the term of this patent is extended or adjusted under 35 U.S.C. 154(b) by 851 days.

(21) Appl. No.: 14/368,176

(22) PCT Filed: Dec. 13, 2012

(86) PCT No.: PCT/JP2012/082286

§ 371 (c)(1),
(2) Date: Jun. 23, 2014

(87) PCT Pub. No.: WO2013/099618

PCT Pub. Date: Jul. 4, 2013

(65) Prior Publication Data

US 2014/0370283 A1 Dec. 18, 2014

(30) Foreign Application Priority Data

Dec. 27, 2011 (JP) ..... 2011-285119
Apr. 26, 2012 (JP) ..... 2012-100943

(51) Int. Cl.
*D02G 3/00* (2006.01)
*D01F 8/14* (2006.01)
(Continued)

(52) U.S. Cl.
CPC ..... *D01F 8/14* (2013.01); *D01D 5/08* (2013.01); *D04H 1/435* (2013.01);
(Continued)

(58) Field of Classification Search
CPC ..... D01D 5/08; D01F 8/14
See application file for complete search history.

(56) References Cited

U.S. PATENT DOCUMENTS

2004/0209077 A1* 10/2004 Yoon ..... D01F 1/04 428/359
2009/0286436 A1* 11/2009 Koide ..... D01F 8/14 442/59

FOREIGN PATENT DOCUMENTS

JP 48-39368 B1 11/1973
JP S 55-20011 B2 5/1980
(Continued)

OTHER PUBLICATIONS

English Machine Translation: Kitawaki (JP 2005002510).*
English Machine Translation: Kim et al. (JP 06-316814).*
Bauer-Kurz, Fiber Crimp and Crimp Stability in Nonwoven Fabric Processes, 2000.*
European Search Report dated Jul. 6, 2015 for European Application No. 12863483.9.
International Search Report for PCT International Application No. PCT/JP2012/082286 dated Feb. 12, 2013.

*Primary Examiner* — Holly Rickman
*Assistant Examiner* — Linda Chau
(74) *Attorney, Agent, or Firm* — RatnerPrestia

(57) ABSTRACT

The present invention provides a conjugated fiber suitable for use as a crimped fiber capable of producing an artificial leather having highly dense texture and good quality. The present invention also provides a base body for an artificial leather and an artificial leather produced by using such conjugated fiber. The conjugated fiber of the present invention includes a conjugated fiber comprising a readily soluble polyester component and a less readily soluble component, and the readily soluble polyester component comprises a copolymerized polyester having 5 to 10% by mole of 5-sodium sulfoisophthalate copolymerized therewith and the readily soluble polyester component contains a polyalkylene glycol. The polyalkylene glycol is in the form of streaks extending in longitudinal direction of the fiber in the longitudinal cross section of the conjugated fiber.

8 Claims, 2 Drawing Sheets

(51) Int. Cl.

| | |
|---|---|
| ***D01D 5/08*** | (2006.01) |
| ***D06N 3/12*** | (2006.01) |
| ***D06N 3/00*** | (2006.01) |
| ***D06N 3/14*** | (2006.01) |
| ***D04H 1/435*** | (2012.01) |
| ***D04H 1/4382*** | (2012.01) |

(52) U.S. Cl.
CPC ..... *D04H 1/4382* (2013.01); *D06N 3/0011* (2013.01); *D06N 3/0036* (2013.01); *D06N 3/123* (2013.01); *D06N 3/14* (2013.01); *D06N 2201/10* (2013.01); *D06N 2211/28* (2013.01); *Y10T 428/2924* (2015.01); *Y10T 428/2929* (2015.01)

(56) References Cited

FOREIGN PATENT DOCUMENTS

| | | | | |
|---|---|---|---|---|
| JP | 6-316814 | A | | 11/1994 |
| JP | 2809748 | B2 | | 10/1998 |
| JP | 2867582 | | | 3/1999 |
| JP | 2001-055670 | A | | 2/2001 |
| JP | 2005-002510 | A | | 1/2005 |
| JP | 2005002510 | A | * | 1/2005 |
| WO | 0242528 | | | 5/2002 |

* cited by examiner

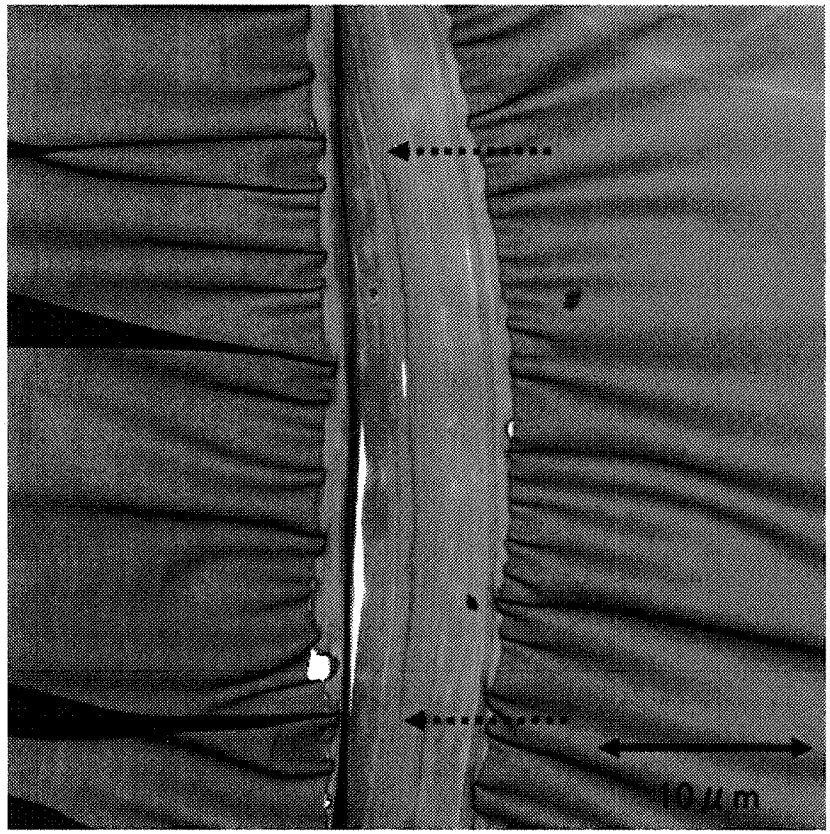
【Fig. 1】

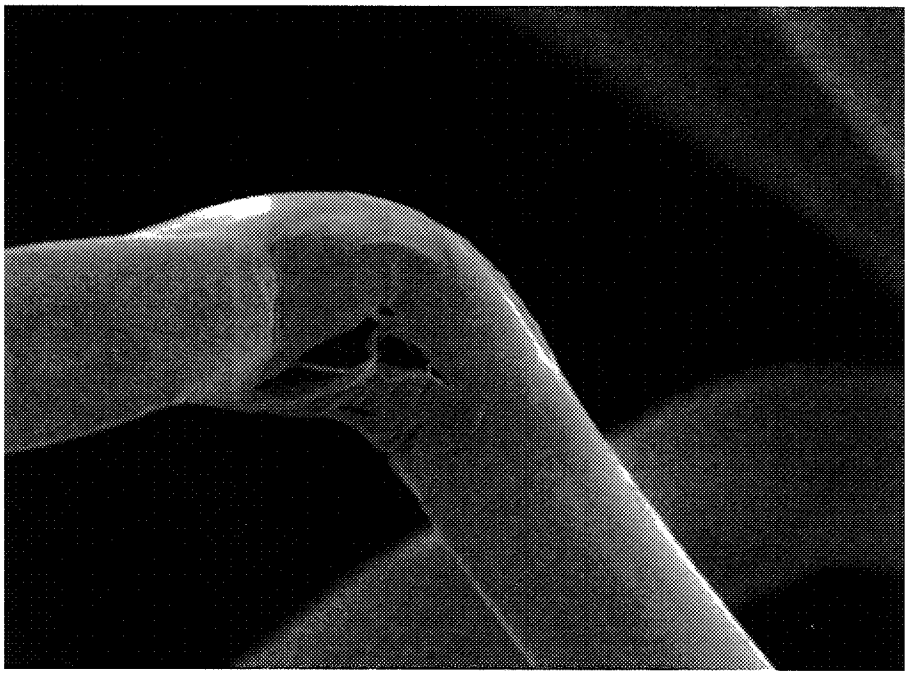
【Fig. 2】

CONJUGATED FIBER, BASE BODY FOR ARTIFICIAL LEATHER, AND ARTIFICIAL LEATHER

CROSS REFERENCE TO RELATED APPLICATIONS

This is the U.S. National Phase application of PCT/JP2012/082286, filed Dec. 13, 2012, which claims priority to Japanese Patent Application Nos. 2011-285119, filed Dec. 27, 2011, and Japanese Patent Application No. 2012-100943, filed Apr. 26, 2012, the disclosures of each of these applications being incorporated herein by reference in their entireties for all purposes.

FIELD OF THE INVENTION

This invention relates to a conjugated fiber suitable for producing an artificial leather comprising a base body for an artificial leather with highly dense texture and good quality. This invention also relates to a base body for an artificial leather and an artificial leather.

BACKGROUND OF THE INVENTION

Artificial leathers are commonly produced by a method wherein an elastic polymer is applied on a nonwoven fabric obtained by intertwining ultrafine fiber-generating fibers, and the ultrafine fibers are generated to thereby produce the artificial leather. The methods commonly used in the intertwining of the ultrafine fiber-generating fibers include needle punching and water jet punching, and the intertwining by the needle punching is known to generally involve complicated events due to the friction between the needle material and the fiber as well as rigidity, strength, and crimping of the staple fiber.

Artificial leathers are likely to have higher quality and superior physical properties such as abrasion properties when the sheet such as the nonwoven fabric constituting the base body for the artificial leather has a higher fiber density and highly dense texture. Accordingly, it has been a general requirement that the base body for an artificial leather is a sheet having a high degree of intertwining and density.

One solution to such requirement is increase in the number of punching in the needle punching to facilitate the fiber orientation in thickness direction. In view of such situation, use of a polymer capable of forming a fiber with higher rigidity had been preferred so that the fiber can endure repeated needle punching. For example, a particular type of highly rigid polystyrene has been used for the sea component of the islands-in-the-sea conjugated fiber which is a fiber known for use in generating the ultrafine fiber for the purpose of realizing high degree of intertwining in the needle punching (see Patent Document 1). However, the number of needle punching that could be effected in this method has been limited due to the amorphous and brittle nature of the polystyrene, and a base body for an artificial leather having a fully sufficient degree of density and intertwining is not yet realized.

In view of such situation as well as recent rise of environmental consciousness, production of an artificial leather by a process not using an organic solvent has gained attention, and various investigation have been made with the attempts of using a crystalline copolymerized polyester which is readily soluble by an alkali treatment for the sea component in the generation of the ultrafine fiber (see Patent Document 2).

PATENT DOCUMENTS

Patent Document 1: Japanese Patent Publication SHO 55-20011

Patent Document 2: Japanese Patent Application Laid-Open No. 2001-55670

SUMMARY OF THE INVENTION

The polyester fibers used in the conventional technology as described above using a copolymerized polyester for the sea component was inferior in the fiber rigidity compared to the polymer such as polystyrene, and therefore, they suffered from the problem that they were more likely to be flattened in the thickness direction in the initial stage of the needle punching, difficulty in improving the intertwining efficiency, and difficulty in increasing the density.

In view of the problems of the conventional technology as described above, the present invention aims to provide a conjugated fiber adapted for use in producing an artificial leather comprising a base body for an artificial leather which exhibits high intertwining efficiency in the needle punching.

The present invention also aims to provide a base body for an artificial leather and an artificial leather having a highly dense texture and good quality prepared by using the conjugated fiber of the present invention.

Accordingly, the present invention intends to solve the problems as described above, and the conjugated fiber of an embodiment of the present invention comprises a readily soluble polyester component and a less readily soluble component wherein the readily soluble polyester component comprises a copolymerized polyester having 5 to 10% by mole of 5-sodium sulfoisophthalate copolymerized therewith and the readily soluble polyester component contains a polyalkylene glycol.

According to a preferred embodiment of the conjugated fiber of the present invention, the polyalkylene glycol is blended in the copolymerized polyester.

According to the preferred embodiment of the conjugated fiber of the present invention, the content of the polyalkylene glycol in the readily soluble polyester component is 1 to 10% by weight.

According to the preferred embodiment of the conjugated fiber of the present invention, the polyalkylene glycol is polyethylene glycol.

According to the preferred embodiment of the conjugated fiber of the present invention, the polyalkylene glycol extends in the longitudinal direction of the fiber in the longitudinal cross section of the conjugated fiber.

According to the preferred embodiment of the conjugated fiber of the present invention, the polyalkylene glycol extending in the longitudinal direction of the fiber in the form of streaks has a length of 15 μm.

According to the preferred embodiment of the conjugated fiber of the present invention, the fiber has been crimped by buckling and crack and/or crevice is present in the buckled part.

According to the preferred embodiment of the conjugated fiber of the present invention, shrinkage rate at 98° C. of the conjugated fiber is in the range of 10 to 40%.

In the present invention, a base body for an artificial leather can be produced by using the conjugated fiber as described above, and an artificial leather can be produced by using the base body for an artificial leather.

In the present invention, a base body for an artificial leather can be produced by using the conjugated fiber as described above which has been further crimped by buckling, and an artificial leather can be produced by using such base body for an artificial leather.

The method for producing the conjugated fiber of an embodiment of the present invention is a method for producing a conjugated fiber comprising a readily soluble polyester component and a less readily soluble component, wherein 5 to 10% by mole of 5-sodium sulfoisophthalic acid is copolymerized with the polyester to prepare a copolymerized polyester and a polyalkylene glycol is added to the copolymerized polyester in the melt spinning.

According to the present invention, presence of the polyalkylene glycol in the form of streaks extending in the longitudinal direction in the longitudinal cross section of the conjugated fiber enables production of a conjugated fiber which can be used in the fabrication of an artificial leather having a highly dense surface quality and good abrasion resistance comprising a base body for an artificial leather having a good crimp retention property, high degree of intertwining, and a potential of increasing the density.

In addition, the present invention provides an artificial leather having a highly dense surface quality and good abrasion resistance comprising a base body for an artificial leather having a good crimp retention property, high degree of intertwining, and a potential of increasing the density.

BRIEF DESCRIPTION OF THE DRAWINGS

FIG. 1 is a photograph as a substitute for a drawing which shows the polyalkylene glycol extending as a streak in the conjugated fiber of an embodiment of the present invention in the machine direction.

FIG. 2 is a photograph as a substitute for a drawing showing the presence of cracks in the buckled part of the conjugated fiber of an embodiment of the present invention.

DETAILED DESCRIPTION OF EMBODIMENTS OF THE INVENTION

In the conjugated fiber of the present invention, it is preferred that the conjugated fiber comprises a readily soluble polyester component and a less readily soluble component, and the readily soluble polyester component comprises a copolymerized polyester having 5 to 10% by mole of 5-sodium sulfoisophthalate copolymerized therewith and the readily soluble polyester component contains a polyalkylene glycol.

Examples of the polyalkylene glycol in the readily soluble polyester component constituting the conjugated fiber of the present invention include polyethylene glycol, polypropylene glycol, and polybutylene glycol, and the preferred is polyethylene glycol in view of handling convenience, ease of weight reduction by an alkali, and the like.

The conjugated fiber of an embodiment of the present invention is a conjugated fiber comprising a readily soluble polyester component and a less readily soluble component wherein the readily soluble polyester component comprises a copolymerized polyester having 5 to 10% by mole of 5-sodium sulfoisophthalate copolymerized therewith and the readily soluble polyester component contains a polyalkylene glycol. The polyalkylene glycol is preferably in the form of streaks extending in longitudinal direction of the fiber in the longitudinal cross section of the conjugated fiber.

The copolymerized polyester constituting the readily soluble polyester component used in the conjugated fiber of the present invention preferably has 5 to 10% by mole of 5-sodium sulfoisophthalicate copolymerized therewith as its copolymer component. The content of this copolymer component is preferably 6 to 9% by mole. When 5% by mole or more 5-sodium sulfoisophthalicate component is copolymerized as a copolymer component, sufficient weight reduction can be realized by using an alkali, and the conjugated fiber will have sufficient brittleness (breakability in the crimping by buckling). This facilitates generation of cracks in the fiber and thermal fixing in the blending of the polyalkylene glycol as described below. The copolymerization of the up to 10% by mole of the 5-sodium sulfoisophthalate component as a copolymer component prevents increase in the melt viscosity and this results in the effect of reducing the unexpected cut of the fiber in the melt-spinning of the conjugated fiber.

The polyalkylene glycol used in the present invention may preferably have a number average molecular weight in the range of 5,000 to 50,000, and more preferably, a number average molecular weight of 10,000 to 30,000. Use of the polyalkylene glycol having such number average molecular weight will facilitate not only the mixing in the course of the spinning but also the alkaline removal at a sufficient speed.

Content of the polyalkylene glycol in the readily soluble polyester component is preferably in the range of 1 to 10% by weight, and more preferably 2 to 8% by weight. Incorporation of the polyalkylene glycol at an amount of at least 1% by weight will provide the conjugated fiber of the present invention with the desirable crimp retention property which is the characteristic feature of the conjugated fiber of the present invention, while incorporation of the polyalkylene glycol at an amount of up to 10% by weight will not invite the unexpected cut of the fiber in the melt-spinning of the conjugated fiber.

In the conjugated fiber of an embodiment of the present invention, the polyalkylene glycol is in the form of streaks extending in longitudinal direction of the fiber in the longitudinal cross section of the conjugated fiber. When the polyalkylene glycol is present as streaks extending in the longitudinal direction of the fiber in the sea component which is the readily soluble polyester component of the conjugated fiber, formation the cracks and/or crevices is facilitated in the crimped part during the crimping by buckling of the conjugated fiber. The crimps in the cracked and/or creviced part are thereby fixed, and crimp retention property will be improved. The crimp retention property can be confirmed, for example, by measuring compression recovery rate of the fiber web.

In the conjugated fiber of the present invention, the polyalkylene glycol in the form of streaks preferably includes those having a length in longitudinal direction of 10 μm or more. When the polyalkylene glycol in the form of streaks extending in longitudinal direction having a length of at least 10 μm, more preferably, at least 15 μm, and still more preferably at least 20 μm is present in the fiber, the crack formation is efficiently promoted in the buckling and crimping treatment. In the meanwhile, the crack formation in the process other than the buckling and crimping treatment, for example, in the spinning and needle punching can be reduced by regulating the length of the polyalkylene glycol in the form of streaks to the range of preferably up to 200 μm, more preferably up to 180 μm, and still more preferably up to 160 μm.

The state that "the polyalkylene glycol is present in the form of streaks extending in longitudinal direction" in the present invention corresponds to the state that the polyalkylene glycol is not in the cyclic state, and more specifically, opposite ends of each polyalkylene glycol chain are preferably not in contact with each other, and the difference between the length of the straight line between the opposite ends and the actually measured length of the alkylene chain length (which is 0% in the case of perfect straight line) is preferably up to 20%.

FIG. 1 is a photograph as a substitute for a drawing which shows the polyalkylene glycol extending in the form of streaks in the conjugated fiber of an embodiment of the present invention in the longitudinal direction of the fiber. FIG. 2 is a photograph as a substitute for a drawing showing the presence of cracks in the buckled part of the conjugated fiber of an embodiment of the present invention.

Since the polyalkylene glycol is present as streaks extending in longitudinal direction of the sea component of the conjugated fiber as shown in FIG. 1, when the conjugated fiber is crimped by buckling, cracks are generated in the buckled part of the crimp with the polyalkylene glycol extending in the longitudinal direction of the fiber acting as the starting point, and the crimp is retained by the fixing of the cracks.

In the conjugated fiber of an embodiment of the present invention, the polyalkylene glycol is present in the form of streaks extending in the longitudinal direction of the sea component which is the readily soluble polyester component. Accordingly, cracks and/or crevices are preferably present in the buckled part formed by the crimping. The cracks and/or crevices are observed by using a scanning electron microscope at a magnification of 1000, and more specifically, the crimped part of the conjugated fiber is observed for the cracks in the buckled part of the crimps. When 30 buckled parts of the crimps are observed and the cracks and/or crevices are observed in 5 or more locations, and the cracks and/or crevices are evaluated to be "present". The cracks and/or crevices are preferably present at 10 or more locations in the observation of 30 locations of the buckled parts of the crimps.

The maximum length of the cracks and/or crevices is preferably at least 10 an, and more preferably at least 15 μm. When the maximum length of the cracks and/or crevices is within such range, sufficient crimp retention property is realized. However, excessively long cracks and/or crevices invite loss of crimp retention property, and the maximum length is preferably up to 200 μm.

The number of the buckling is preferably 5 to 30 per 2.52 cm, and more preferably 10 to 25 per 2.52 cm. The shape (angle) of the buckled part is preferably an acute angle, and more specifically, the buckled part is preferably up to 120°, and more preferably up to 90°. The angle of the buckled part is at least 20° since sufficient crimp retention property is not obtained when the angle of the buckled part is too acute.

The ratio of the readily soluble polyester component to the less readily soluble component constituting the conjugated fiber of the present invention is preferably 0.2 to 0.8, and more preferably 0.3 to 0.7 in terms of the weight ratio of the less readily soluble component to the conjugated fiber. When the weight ratio of the less readily soluble component to the conjugated fiber is at least 0.2, the removal rate of the readily soluble polyester component is reduced and the productivity will be improved. When the weight ratio of the less readily soluble component to the conjugated fiber is up to 0.8, opening property of the fiber comprising the less readily soluble component will be improved, and joining of the less readily soluble component will be prevented.

The readily soluble polyester component constituting the conjugated fiber of the present invention preferably contains a polyethylene terephthalate polyester wherein the constitutional repeating unit mainly comprises ethylene terephthalate as one component, and the polyester may be the one wherein a part of the terephthalic acid component is substituted with other difunctional carboxylic acid component. Similarly, the polyester may be the one wherein a part of the ethylene glycol component is substituted with other polyol component.

Exemplary preferable difunctional carboxylic acid other than the terephthalic acid used in the present invention include aromatic, aliphatic, and alicyclic difunctional carboxylic acids such as isophthalic acid, naphthaline dicarboxylic acid, diphenyl dicarboxylic acid, adipic acid, sebacic acid, and 1,4-cyclohexane dicarboxylic acid, and exemplary polyol compounds other than the ethylene glycol include aliphatic, alicyclic, and aromatic polyol compounds such as tetramethylene glycol, hexamethylene glycol, cyclohexane-1,4-dimethanol, neopentyl glycol, bisphenol A, and bisphenol S.

Examples of the less readily soluble component constituting the conjugated fiber of the present invention include polyester, polyamide, polyolefin, and polyphenylene sulfide as described above. Many polycondensation polymers as typically represented by polyesters and polyamides have high melting point, and production of an artificial leather having good performance is enabled by using such polycondensation polymer. Examples of the polyester include polyethylene terephthalate, polybuthylene terephthalate, and polytrimethylene terephthalate, and examples of the polyamide include nylon 6, nylon 66, and nylon 12.

A readily soluble polyester component is a polyester component which exhibits solubility at least 100 times, and preferably at least 200 times higher than the solubility of the less readily soluble polyester component to the solvent such as an organic solvent and the aqueous solution of alkali or the like. When the difference in the solubility is 100 times or higher, the damages done to the less readily soluble component will be reduced in the elution step, and the less readily soluble component will be well dispersed.

Preferable examples of the conjugated fiber of the present invention include the polymer arranged fiber according to Japanese Patent Publication No. SHO 48-2216 and the like wherein each fiber is formed by integrating many less readily soluble fiber components continuously arranged in the longitudinal length of the fiber, and the mix-spun fiber according to Japanese Patent Publication No. SHO-51-21041 and the like wherein each fiber is formed by integrating many fine fiber components uncontinuously arranged in the longitudinal length of the fiber (due to the limitation in the fiber length), and the split-type conjugated fiber according to Japanese Patent Application Laid-Open No. 9-310230 wherein the less readily soluble component is divided by the readily soluble component into two or more parts in the cross section of the fiber. When the readily soluble component is removed from the thus obtained conjugated fiber by using a solvent or the like, the less readily soluble component having a fineness lower than the conjugated fiber can be selectively collected.

The conjugated fiber of the present invention may have a single fiber fineness in the range of 2 to 10 dtex, and more preferably 3 to 9 dtex in view of the fiber intertwining property in the needle punching and other steps.

With regard to the type of the conjugated fiber of the present invention, the preferred are an islands-in-the-sea conjugated fiber and a mix-spun fiber in view of the luxuriousness, quality, texture, and the like when used for the production of the artificial leather as will be described below.

The ultrafine fiber obtained from the conjugated fiber may preferably have an average single fiber diameter in the range of 0.1 to 10 μm. When the average single fiber diameter is up to 10 μm, and preferably up to 5 μm, the resulting artificial leather, for example, a suede-like artificial leather will enjoy good texture. On the other hand, high fiber strength and rigidity will be retained when the average single fiber diameter is at least 0.1 μm, and preferably at least 0.5 μm.

The components (polymers), namely, the readily soluble polyester component and the less readily soluble component constituting the conjugated fiber used in the present invention may contain additives such as particles, flame retardants, and antistatic agents added thereto.

The conjugated fiber of the present invention may be crimped by buckling. Crimp retention index of the conjugated fiber when the conjugated fiber has been crimped by buckling is preferably in the range of 3.5 to 10, and more preferably 4 to 10. The crimp retention index in the present invention is the one represented by the following equation.

$$\text{Crimp retention index}=(W/L-L_0)^{1/2}$$

W: load at the crimp disappearance (the load applied when the crimps had been fully elongated: mg/dtex);

L: fiber length (cm) under the load of the crimp disappearance;

$L_0$: fiber length (cm) at 6 mg/dtex. The position at 30.0 cm is marked.

In the measurement of the crimp retention index, a load of 100 mg/dtex is first applied, and the load is increased at an increment of 10 mg/dtex while confirming the state of the crimps in each increase of the load. The load is increased until the crimps are fully elongated, and the length at the marking when the crimps are fully elongated (elongation from 30.0 cm) is measured.

When the crimp retention index is 3.5 or higher, the resulting nonwoven fabric will have an improved rigidity in the thickness direction, and intertwining property will be retained in the intertwining step such as needle punching. When the crimp retention index is up to 10, excessive crimping will be prevented, and this results in the good opening of the fiber web in the curding.

The conjugated fiber of the present invention preferably has a shrinkage rate at 98° C. of 10 to 40%, and more preferably 12 to 35%. When the shrinkage rate is within the range as described above, the resulting product of the conjugated fiber, namely, the base body for an artificial leather will have an improved quality. In the actual measurement of the shrinkage rate, a load of 50 mg/dtex was applied to a tow of conjugated fibers, and the position at 30.0 cm was marked ($L_0$). The tow is then treated with hot water at 98° C. for 10 minutes. The length before the treatment and the length after the treatment ($L_1$) are measured to calculate $(L_0-L_1)/L_0\times100$. The measurement is conducted three times, and the average is used for the shrinkage rate.

An intertwined fiber body can be formed by using the conjugated fiber of the present invention. Exemplary intertwined fiber bodies include woven, knitted, nonwoven, and other fabrics, and the most preferred is use of a nonwoven fabric prepared by intertwining a tow of ultrafine fibers (ultrafine fiber tow) in view of the surface uniformity and the strength. The base body for an artificial leather is obtained by applying an elastic polymer or the like to the thus obtained nonwoven fabric.

The form of the ultrafine fiber tow obtained after removing the polymer of the readily soluble polyester component from the conjugated fibers of the present invention may be the one wherein the ultrafine fibers are mutually distanced from each other to some degree, the one wherein the ultrafine fibers are partly bonded, or the one wherein the ultrafine fibers are partly aggregated.

The nonwoven fabric which is the intertwined fiber body obtained by using the conjugated fiber of the present invention may be used as a base body for an artificial leather. Exemplary nonwoven fabrics include short fiber nonwoven fabrics prepared by forming a laminated fiber web by curding or by the use of a cross wrapper, and subjecting the laminated fiber web to needle punching, water jet punching, or the like; long fiber nonwoven fabrics obtained by spun bonding, melt blowing, or the like; and nonwoven fabrics obtained by a paper making method. Among these, the preferred is use of a short fiber nonwoven fabric and a spun bond nonwoven fabric in view of the ease of producing the fabric having a highly uniform thickness.

The nonwoven fabric obtained by using the conjugated fiber of the present invention preferably has a compression recovery rate as measured by "Testing methods for synthetic fibre wadding" according to JIS L1097 (1982) of 80 to 100% at the stage before the intertwining treatment such as needle punching. More preferably, the compression recovery rate is in the range of 85 to 100%. When the compression recovery rate is at least 80%, the intertwined fibers are less likely to become flattened in the intertwining treatment by the needle punching and this enables the intertwining treatment at a high efficiency. The resulting base body for an artificial leather will be proved with a higher density and a higher strength.

The nonwoven fabric produced by using the conjugated fiber of the present invention may be backed by or laminating with a woven or knitted fabric for the purpose of improving the strength and the like. When the nonwoven fabric and the woven or knitted fabric are integrated by lamination and needle punching of the fabrics, a hard twist yarn is preferably used for the thread of the woven or knitted fabric to prevent damages done to the fibers constituting the woven or knitted fabric by the needle punching. The thread constituting the woven or knitted fabric is preferably in the range of 700 T/m to 4500 T/m, and the fiber diameter of the woven or knitted fabric may be the same or less than the fiber diameter of the ultrafine fiber nonwoven fabric.

An elastic polymer may be applied to the nonwoven fabric obtained by using the conjugated fiber of the present invention. The elastic polymer has a binder effect which prevents falling of the conjugated fiber off the artificial leather, and also, the nonwoven fabric will have an adequate cushioning property.

Examples of the elastic polymer applied to the nonwoven fabric obtained by using the conjugated fiber of the present invention include polyurethane, polyurea, polyurethane-polyurea elastomer, polyacrylic acid, acrylonitrile-butadiene elastomer, and styrene-butadiene elastomer. The preferred is use of a polyurethane in view of the softness and cushioning property.

Exemplary polyurethanes include a polyurethane or a modified polyurethane produced by reacting at least one polymer diol having an average molecular weight of 500 to 3000 selected from polyester diols, polyether diols, polycarbonate diols, and polyester polyether diols, at least one diisocyanate selected from aromatic diisocyanates such as 4,4'-diphenylmethanediisocyanate, alicyclic diisocyanates such as isophorone diisocyanate, and aliphatic diisocyanates such as hexamethylene diisocyanate, and at least one low molecular weight compound having at least 2 active hydrogen atoms such as ethylene glycol, butanediol, ethylenediamine, or 4,4'-diaminodiphenylmethane at a predetermined molar ratio.

The polyurethane elastomer may preferably have a weight average molecular weight of 50,000 to 300,000. The artificial leather will retain its strength, and falling of the conjugated fiber off the artificial leather will be prevented when the weight average molecular weight is at least 50,000, more preferably at least 100,000, and still more preferably at least 150,000. On the other hand; increase in the viscosity of the polyurethane solution can be suppressed to facilitate impregnation in the nonwoven fabric by regulating the weight average molecular weight to the range of up to 300,000, and more preferably up to 250,000.

The elastic polymer may also contain an elastomer resin such as polyester, polyamide, polyolefin, or other elastomer resin, an acrylic resin, an ethylene-vinyl acetate resin, or the like.

If desired, the elastic polymer used in the present invention may also have additives blended therewith. Exemplary such additives include a pigment such as carbon black, a dye antioxidant, an antioxidant, a lightproofing agent, an antistatic agent, a dispersant, a softening agent, an anticoagulant, a flame retardant, an antimicrobial agent, and an antideodrant.

The elastic polymer may be either in the form of a solution in an organic solvent or a dispersion in water.

Content of the elastic polymer is preferably 5 to 200% by weight in relation to the nonwoven fabric comprising the intertwined ultrafine fiber tows. Surface condition, cushioning property, hardness, strength, and the like of the artificial leather can be adjusted by changing the elastic polymer content. Falling of the fiber off the leather can be reduced by adjusting the content to the range of at least 5% by weight, more preferably to the range of at least 20% by weight, and still more preferably to the range of according to 30% by weight. On the other hand, the ultrafine fiber will be consistently dispersed on the surface when the content is up to 200% by weight, more preferably up to 100% by weight, and still more preferably up to 80% by weight.

The weight per unit area of the base body for an artificial leather comprising the ultrafine fiber tow is preferably in the range of 100 to 500 g/m$^2$. When the weight per unit area of the base body for an artificial leather is preferably at least 100 g/m$^2$, and more preferably at least 150 g/m$^2$, the base body for the artificial leather will have sufficient shape and size stabilities. On the other hand, when the weight per unit area is preferably up to 500 g/m$^2$, and more preferably up to 300 g/m$^2$, the base body for the artificial leather will have a sufficient softness.

The thickness of the base body for an artificial leather of the present invention is preferably 0.1 to 10 mm. Sufficient shape and size stabilities are realized by using a thickness of at 0.1 mm or more, and preferably 0.3 mm or more. On the other hand, sufficient softness is realized by limiting the thickness to the range of up to 10 mm, and more preferably up to 5 mm.

Preferably, one surface of the base body for an artificial leather of the present invention is subjected to a napping treatment, and such treatment provide dense texture with the product when the base body is used in producing a suede-like artificial leather.

Next, a method for producing a conjugated fiber, a method for producing a base body for an artificial leather, and a method for producing an artificial leather of the present invention are described.

The conjugated fiber of the present invention may be an islands-in-the-sea fiber prepared by using 2 types of thermoplastic resins having solubility in the solvent or the like different from each other for the sea and island components, and removing the sea component by using the solvent or the like in the subsequent step to thereby obtain a ultrafine fiber comprising the island component, and a splittable conjugated fiber prepared by alternately arranging 2 types of thermoplastic resins radially or in the form of a laminate in the fiber cross-section, and segmenting the fiber by peeling and splitting each component to thereby form ultrafine fibers.

An intertwined fiber body (nonwoven fabric) can be obtained by the step of preparing the conjugated fiber web by using the conjugated fiber of the present invention, and subjecting the conjugated fiber web to an intertwining treatment to obtain the intertwined fiber body (nonwoven fabric). A base body for an artificial leather can be obtained by removing the polymer of the readily soluble component of the conjugated fiber from the nonwoven fabric by dissolution or by physical or chemical peeling or splitting for the generation of the ultrafine fiber; applying the elastic polymer containing the polyurethane as its main component to the nonwoven fabric before and/or after the ultrafine fiber generation or after the napping treatment; substantially coagulating the elastic polymer for solidification; and conducing the napping treatment to form napps on the surface for thickness consistency. An artificial leather may be obtained by the steps of conducting the finishing by dyeing the base body for an artificial leather.

The islands-in-the-sea fibers include islands-in-the-sea conjugated fiber prepared by using a nozzle for islands-in-the-sea conjugation is, namely, by mutually aligning two components, namely, the sea component and the island component, and spinning the aligned sea and island components from the nozzle; and mix-spun fiber prepared by spinning a mixture of two components, namely, the sea component and the island component. The most preferred is use of an islands-in-the-sea conjugated fiber in view of producing ultrafine fibers having uniform fineness as well as the production of ultrafine fibers with sufficient length contributing for the strength of the resulting base body for an artificial leather.

The readily soluble polyester component, which is the sea component of the islands-in-the-sea fiber comprises a copolymerized polyester having 5 to 10% by mole of 5-sodium sulfoisophthalate copolymerized therewith and a polyalkylene glycol. Preferably, the 5-sodium sulfoisophthalate is added during the polymer polymerization for copolymerization, and the polyalkylene glycol is added in the spinning.

The mixing of the polyalkylene glycol with the readily soluble polyester component may be accomplished by the method wherein the polyalkylene glycol is added after the completion of the polymer polymerization. However, the polyalkylene glycol is preferably mixed during the melt spinning in view of regulating the thermal degradation and molecular chain structure of the polyalkylene glycol. In addition, the molecular chain of the polyalkylene glycol should be present in the form of streaks extending in the longitudinal direction of the conjugated fiber (readily soluble polyester component). When the polyalkylene glycol is present in the form of streaks extending in the longitudinal direction of the fiber, crack formation on the surface of the conjugated fiber in the crimping by buckling is facilitated, and in addition, the crimp retention effect by the elution and solidification of the polyalkylene glycol by heat is also realized. On the other hand, when the polyalkylene glycol is mixed after the polymerization reaction, the molecular chain of the polyalkylene glycol will be in stable structure in the form of circle or oblong, and the chain is less likely to be deformed into the form of streaks extending in the longitudinal direction of the fiber in the spinning.

As described above, the conjugated fiber of the present invention may preferably have a shrinkage rate at 98° C. of preferably 10 to 40%, and more preferably 12 to 35%. When the shrinkage rate is limited to the range as described above, the nonwoven fabric will enjoy highly dense texture when used for the base body for an artificial leather, and this in turn results in the improved quality of the product. The shrinkage rate may be regulated to the range as described above, for example, by conducting the stretching under a low temperature condition at which the shrinkage behavior is not suppressed. In the conjugated fiber of the present invention, such condition can be realized by conducting the stretching at a temperature of up to 85° C.

The conjugated fiber of the present invention is preferably crimped by buckling since crimping by buckling results in the improved intertwining between the fibers after the formation of the short fiber nonwoven fabric, and a higher density as well as a higher degree of intertwining are thereby realized. The crimping by buckling of the conjugated fiber is preferably accomplished by a stuffing box-type crimper commonly used in the art, and in the present invention, crimped fineness, crimper temperature, crimper load, press pressure, and other parameters are preferably adjusted to obtain preferable crimp retention index. Among these, the most important is the crimper temperature (temperature in the crimping), and the preferable temperature is in the range of 40 to 80° C. The presence of the polyalkylene glycol of the readily soluble polyester component on the conjugated fiber surface facilitates buckling at the part on the conjugated fiber where the polyalkylene glycol is present upon crimping. The dissolution of the polyalkylene glycol component and breakage of the fiber surface are facilitated by conducing the crimping at a temperature of at least 40° C. On the other hand, crimping at a temperature of up to 80° C. prevents excessive thermal setting of the conjugated fiber and suppression of the shrinking behavior in the subsequent step. As described above, limitation of the crimping temperature facilitates realization of the crimping effects.

When used for the base body for an artificial leather, the removal by dissolution of the sea component of the conjugated fiber of the present invention may be conducted either before or after the application of the elastic polymer, or after the napping treatment.

As described above, exemplary methods which may be used in producing a nonwoven fabric comprising a conjugated fiber include the method wherein the fiber webs are intertwined by needle punching or water jet punching, spun bonding, melt blowing, and paper making method, and among these, the preferred is the methods using the needle punching or water jet punching in view of carrying out the embodiment using the ultrafine fiber tow as described above.

As described above, the nonwoven fabric may be integrated with a woven or knitted fabric by laminating the nonwoven fabric and the woven or knitted fabric one on the other, and the preferred is the method wherein the integration is accomplished by needle punching or water jet punching.

The needle used in the needle punching may preferably have 1 to 9 needle barbs (notches). An efficient fiber intertwining is enabled by providing at least 1 needle barb with the needle while damages done to the fibers can be suppressed by limiting the number of barbs to up to 9 needle barbs.

The number of the conjugated fibers such as the ultrafine fiber-generating fibers caught by the barb depends on the shape of the barb and the diameter of the conjugated fiber. Accordingly, the barb of the needle used in the needle punching step is preferably the one shaped to have a kick-up of 0 to 50 μm, an undercut angle of 0 to 40, a throat depth of 40 to 80 μm, and a throat length of 0.5 to 1.0 mm.

The number of punching is preferably in the range of 1000 to 8000 punchings/cm$^2$. When the number of punching is preferably at least 1000 punching/cm$^2$, higher density as well as higher precision finishing will be realized. On the other hand, loss of processability, fiber damages, and decrease in the strength will be prevented by limiting the number of punching to the range of preferably up to 8000 punchings/cm$^2$.

In addition, when a woven or knitted fabric and a nonwoven fabric comprising an ultrafine fiber-generating fiber are integrated by lamination, the direction of the barb of the needle used in the needle punching of the laminate is preferably at an angle 90±15° in relation to the machine direction of the sheet, and this prevents hooking of the wefts which are more susceptible to be damaged.

When the water jet punching is conducted, the water is preferably in a columnar flow. More specifically, the water is preferably ejected from the nozzle having a diameter of 0.05 to 1.0 mm at a pressure of 1 to 60 MPa.

The apparent density of the nonwoven fabric comprising the conjugated fiber after the needle punching or the aqueous water jet punching is preferably 0.15 to 0.45 g/cm$^3$. The base body for an artificial leather will have a sufficient form and size stabilities when the apparent density is preferably at least 0.15 g/cm$^3$, while a space sufficient for applying the elastic polymer will be retained when the apparent density is preferably up to 0.45 g/cm$^3$.

In the preferred embodiment, the thus obtained nonwoven fabric for the ultrafine fiber generation is further shrunk by dry heating, wet heating, or both for the realization of a dense texture and increasing the density.

The solvent used for dissolving the readily soluble polyester component (sea component) in the ultrafine fiber-generating fiber may be an alkaline aqueous solution such as sodium hydroxide when the sea component is a polylactic acid or a copolymerized polyester. The treatment of the ultrafine fiber generation (sea removal treatment) may be accomplished by immersing the nonwoven fabric comprising the ultrafine fiber-generating fiber in a solvent, and wringing out the solution.

The treatment of the ultrafine fiber generation may be accomplished by the apparatus known in the art such as continuous dyeing machine, Vibro washer type sea removing machine, jet dyeing machine, wince dyeing machine, or jigger dyeing machine. The process of the ultrafine fiber generation may be conducted either before or after the napping treatment.

The application of the elastic polymer may be conducted either before the process of ultrafine fiber generation or after the process of ultrafine fiber generation.

Preferable examples of the solvent in the case of applying the polyurethane as the elastic polymer include N,N'-dimethylformamide and dimethyl sulfoxide. The polyurethane, however, may be applied as an aqueous dispersion of polyurethane prepared by dispersing the polyurethane in water.

The elastic polymer is applied to the nonwoven fabric by dipping the nonwoven fabric in the solution of the elastic polymer in a solvent, and the elastic polymer is subsequently dried to substantially coagulate and solidify the elastic polymer. In the case of the polyurethane solution in a solvent, the coagulation can be promoted by dipping in a non-solvent, and in the case of gellable aqueous polyurethane solution, the coagulation can be accomplished by a dry coagulation method wherein the polyurethane solution is coagulated after the gelation. The nonwoven fabric and the elastic polymer may be heated to a temperature not adversely affecting the performance of the nonwoven fabric and the elastic polymer.

The base body for an artificial leather of the present invention may have at least one surface napped, and the napping treatment may be accomplished by using a sandpaper or roll sander. In the case of the napping with a sandpaper, napps formed will be consistent and dense. In addition, use of a smaller load in the grinding is preferable for the formation of consistent napps on the surface of the base body for the artificial leather. The use of the smaller load in the grinding can be accomplished, for example, by employing a multi-stage buffing using 3 or more buff stages, and in a preferred embodiment, a sandpaper in the range of No. 150 to No. 600 (according to JIS) is used in each stage.

The base body for an artificial leather comprising the fine fibers obtained from the conjugated fiber of the present invention may contain functional reagents such as dye, pigment, softening agent, anti-pilling agent, antimicrobial agent, deodorant, water repellent, lightproofing agent, and weatherproofing agent.

The base body for an artificial leather comprising the ultrafine fibers obtained from the conjugated fiber of the present invention is preferably dyed. The dyeing is preferably conducted by using a jet dyeing machine since softening by rubbing can be simultaneously accomplished with the dyeing of the base body for an artificial leather. The temperature used in the dyeing is preferably 70 to 120° C., and the dye used is preferably a disperse dye when the less readily soluble component is polyester. A reduction cleaning may be conducted after the dyeing.

In addition, a dyeing aid is preferably used for the purpose of improving dyeing consistency and finishing may be conducted by using a softening agent such as silicone, antistatic agent, water repellent, flame retardant, and lightproofing agent. The finishing may be conducted either after the dyeing or simultaneously with the dyeing.

The artificial leather is obtained by dyeing the base body for an artificial leather as described above.

The base body for an artificial leather produced by using the conjugated fiber of the present invention and the artificial leather produced by using such base body have good quality, and in particular, excellent abrasion resistance. Accordingly, they are well adapted for use in textile applications, miscellaneous applications, CD, DVD, abrasive cloth, cleaning tape, wiping cloth, and other industrial material applications.

EXAMPLE

[Method Used for the Measurement and Preparation the Sample for Measurement]

(1) Melting Point

The measurement was conducted by using DSC-7 manufactured by Perkin Elmer, the peak top temperature indicating the melting of the polymer in the 2nd run was used for the melting point of the polymer. The temperature was elevated at a rate of 16° C./minute, and amount of the sample was 10 mg. The measurement was conducted twice, and the average was used for the melting point.

(2) Melt Flow Rate (MFR)

4 to 5 g of the sample pellet was placed in the cylinder of the electric furnace of the MFR meter, and amount of the resin (g) extruded in 10 minutes was measured by using Melt Indexer (S101) manufactured by Toyo Seiki Col, Ltd. under the conditions of the load of 2160 gf and the temperature of 285° C. The measurement as described above was repeated 3 times, and the average was used as the MFR.

(3) Dispersion of the Polyalkylene Glycol in the Conjugated Fiber

The conjugated fiber was embedded in epoxy resin, and cross sections were prepared by Ultramicrotome (Ultracut-S manufactured by Leica), and the sections were died by $OsO_4$ staining. Ultrathin sections were again prepared by the Ultramicrotome, and the sections were used for observation by TEM. The TEM apparatus used was H-7100 manufactured by Hitachi, Ltd., and the observation was conducted at an acceleration voltage of 100 kV and a magnification of 3000. 3 locations were selected for the polyalkylene glycol extending in the form of streaks in the longitudinal direction of the fiber, and the maximum length was recorded.

(4) Cracks and/or Crevices in the Crimped Part (Buckled Part) of the Conjugated Fiber The crimped part (buckled part) of the conjugated fiber was observed with a scanning electron microscope (SEM) (VE-7800 manufactured by KEYENCE) at a magnification of 1000, and the crimps at an angle of up to 120° were chosen, and the Cracks and/or crevices in the buckled part was observed. 30 buckled parts were observed, and the cracks and/or crevices were evaluated to be "present" when 5 or more buckled parts having the cracks and/or crevices having a length of 15 μm or more were found.

(5) Crimp Retention Index

A load of 6 mg/dtex was applied to the crimped conjugated fiber, and the fiber length (30.0 cm) was accurately measured. This fiber length was $L_0$. Next, the load was increased and the fiber length when the crimps had been fully elongated (elongation from 30.0 cm) was measured. This fiber length was L. By using the load W which is the load when the crimps had been fully elongated, the crimp retention index was calculated by the following equation. In the measurement, a load of 100 mg/dtex was first applied, and the load was increased at an increment of 10 mg/dtex while confirming the state of the crimps in each increase of the load.

$$\text{Crimp retention index}=(W/L-L_0)^{1/2}$$

W: load at the crimp disappearance (the load applied when the crimps had been fully elongated: mg/dtex);

L: fiber length (cm) under the load of the crimp disappearance;

$L_0$: fiber length (cm) at 6 mg/dtex. The position at 30.0 cm was marked.

(6) Shrinkage Rate of the Conjugated Fiber

A load of 50 mg/dtex was applied to a tow of conjugated fibers, and the position at 30.0 cm was marked ($L_0$). The tow was then treated with hot water at 98° C. for 10 minutes. The length before the treatment and the length after the treatment ($L_1$) were measured to calculate $(L_0-L_1)/L_0\times100$. The measurement was conducted three times, and the average was used for the shrinkage rate.

(7) Average Single Fiber Diameter of the Ultrafine Fiber in the Base Body for an Artificial Leather.

The cross section of the nonwoven fabric containing the ultrafine fibers of the conjugated fiber in the direction normal to the thickness was measured by a scanning electron microscope (SEM) (VE-7800 manufactured by KEYENCE) at a magnification of 3000, and the diameter of 50 single fibers randomly chosen from a view of 30 μm×30 μm was observed. This measurement was conducted at 3 locations to measure the diameter of 150 single fibers single fibers in total, and the average was calculated by rounding off the value to nearest integer. When the ultrafine fiber had an irregular cross-section, the cross-sectional area of the single fiber was first measured to calculate the diameter when the cross-section was deemed a true circle, and the single fiber diameter was thereby determined.

(8) Compression Recovery Rate of the Fiber Web

The compression recovery rate of the fiber web was measured according to JIS L1097 (1982) "Testing methods for synthetic fibre wadding" except that the weight of the thick plate of 20×20 cm was changed to 0.93 g/cm$^2$. The fiber web having the compression recovery rate of 85% or higher was evaluated to have a good performance.

(9) Apparent Density of the Nonwoven Fabric

Weight per unit area (g/m$^2$) was measured according to JIS L1913 6.2 (2010), and thickness (mm) was measured by a dial thickness gauge (product of Ozaki Mfg. Co., Ltd.; trade name, "Peacock H" (Registered Trademark)). The apparent density (g/cm$^3$) was calculated by using the values of the weight per unit area and the thickness.

(10) Elongation Ratio in Machine and Transverse Directions of the Nonwoven Fabric Tensile test was conducted according to JIS L19136.3 (2010). Elongation at breakage in the longitudinal (machine) direction and width (transverse) direction of the nonwoven fabric was measured, and the ratio in machine direction to the transverse direction was evaluated. The one having the ratio near 1.0 was evaluated "good".

(11) Martin Dale Abrasion Test

An abrasion test was conducted by the measurement according to JIS L1096(1999)8.17.5 E (Martin dale method) with the load for furniture (12 kPa), and the weight loss of the artificial leather after the abrasion for 20000 times was evaluated. The one with the weight loss by the abrasion of up to 4.0 mg was evaluated to have a good performance.

(12) Surface Quality of the Product

The resulting artificial leather was evaluated in a sensory test by 20 healthy people of both gender. The evaluation was conducted at an increment of 0.5 from 5.0 (best) to 0.0 (worst) for the consistency and dispersion of the nap length. The sample was evaluated to have a good quality when the evaluation result was 3.5 or higher.

Example 1

<Staple Fiber>

(Polymer of the Island Component)

A polyethylene terephthalate (PET) having a melting point of 260° C. and a MFR of 46.5 was used for the polymer of the island component.

(Polymer of the Sea Component)

A PET (Copolymerized PET 1) having 8% by mole of 5-sodium sulfoisophthalate copolymerized therewith having a melting point of 240° C. and a MFR of 100 was used for the polymer of the sea component.

(Spinning and Stretching)

By using the polymers of the sea component and the island component as described above, 2.0% by weight of polyethylene glycol having a molecular weight of 20,000 was melt-blended with the sea component, and the melt spinning was conducted under the conditions including a spinning temperature of 285° C., an island/sea weight ratio of 55/45, an ejection rate of 1.8 g/minute per hole, and a spinning speed of 1200 m/minute by using a 16 islands/hole islands-in-the-sea type conjugated spinning nozzle.

Next, the extrudate was stretched in two stages in a liquid bath at a temperature of 72° C. to a total stretch ratio of 3.4, and crimpled in a stuffing box crimper at a crimping temperature of 65° C. The resulting conjugated fiber had a single fiber fineness of 4.5 dtex, a crimp retention index of 5.6, and a shrinkage rate at 98° C. of 18.5%. This conjugated fiber was cut at a fiber length of 51 mm to obtain a staple fiber for an islands-in-the-sea conjugated fiber.

When the cross-section of the conjugated fiber was observed with a TEM, the polyethylene glycol appeared as streaks extending in the longitudinal direction, and the maximum length was 27 μm. 10 or more buckled parts with the crack having a length of 15 μm or more were observed in the buckled parts formed by crimping.

<Nonwoven Fabric>

A laminated fiber web was formed by subjecting the staple fiber as described above to curding and cross lapping steps. The laminated fiber web before the needle punching exhibited a high rebounding property with the compression recovery rate of 89.0%. Next, the laminated fiber web was subjected to the needle punching by using a needle puncher having one needle having a total barb depth of 0.075 mm at a needle density of 7 mm and a needle number of 4500 needles/cm$^2$ to produce a nonwoven fabric having a weight per unit area of 805 g/m$^2$ and an apparent density of 0.275 g/cm$^3$. In the needle punching, the laminated fiber web experienced little change in the size in the machine direction, and the density could be increased. The elongation was well balanced, and the elongation ratio in machine and transverse directions was 0.96.

<Aqueous Dispersion Type Polyurethane Solution>

An <aqueous dispersion type polyurethane solution> was prepared by adding sodium sulfate (a heat sensitive gelation agent) to a nonionic compulsorily emulsified polyurethane emulsion (polycarbonate type) at an amount of 3% by weight in relation to the polyurethane solid content so that concentration of the polyurethane solution was 10% by weight.

<Artificial Leather>

The nonwoven fabric as described above was shrunk for 3 minutes by exposing to a hot water at a temperature of 98° C., and dried for 5 minutes at a temperature of 100° C. The aqueous dispersion type polyurethane solution as described above was coated on the resulting nonwoven fabric, and the fabric was dried for 5 minutes by a hot air at a drying temperature of 125° C. to obtain a polyurethane-coated nonwoven fabric having a polyurethane coating weight which is 35% by weight in relation to the island component of the nonwoven fabric.

The polyurethane-coated nonwoven fabric was immersed in aqueous sodium hydroxide at a concentration of 20 g/L which had been heated to a temperature of 90° C., and the treatment was continued for 30 minutes to remove the sea component from the islands-in-the-sea conjugated fiber by dissolution. The fabric was then cut in half in thickness direction with a slicer having an endless bank knife, and the non-sliced surface was buffed in three stages by using a JIS #320 sandpaper to form naps to thereby prepare the base body for an artificial leather.

The base body for an artificial leather as described above was dyed with a disperse dye by using a circular drier to prepare an artificial leather. The resulting artificial leather had a good quality with a high density. The weight loss by abrasion was 2.5 mg, and the surface quality was 4.5, both at favorable level. The results are shown in Table 1 (the conjugated fiber) and Table 2 (the fiber web, nonwoven fabric, and the artificial leather).

Example 2

<Staple Fiber>

(Polymer of the Island Component and Polymer of the Sea Component)

The polymers used were the same as those used in Example 1.

(Spinning and Stretching)

The procedure of Example 1 was repeated except that the polymers of the sea component and the island component as described above were used, and 5.0% by weight of polyethylene glycol having a molecular weight of 20,000 was melt-blended. The resulting conjugated fiber had a single fiber fineness of 4.5 dtex, a crimp retention index of 6.1, and a shrinkage rate at 98° C. of 19.1%. This conjugated fiber was cut at a fiber length of 51 mm to obtain a staple fiber for an islands-in-the-sea conjugated fiber. When the cross-section of the conjugated fiber was observed with a TEM, the polyethylene glycol appeared as streaks extending in the longitudinal direction, and the maximum length was 59 μm. 10 or more buckled parts with the crack having a length of 15 μm or more were observed in the buckled parts formed by crimping.

<Nonwoven Fabric>

The staple fiber as described above was processed by repeating the procedure of Example 1 through the curding and cross lapping steps to form a laminated fiber web having a high rebounding property with the compression recovery rate of 89.5%. The resulting laminated fiber web was subjected to the needle punching to produce a nonwoven fabric having a weight per unit area of 811 g/m$^2$ and an apparent density of 0.278 g/cm$^3$. In the needle punching, the laminated fiber web experienced little change in the size in the machine direction, and the density could be increased. The elongation was well balanced, and the elongation ratio in machine and transverse directions was 0.97.

<Artificial Leather>

A base body for an artificial leather and an artificial leather were prepared by repeating the procedure of Example 1 except for the use of the nonwoven fabric as described above. The resulting artificial leather had good quality with high density. The weight loss by abrasion was 2.4 mg, and the surface quality was 5.0, both at favorable level. The results are shown in Tables 1 and 2.

Example 3

<Staple Fiber>

(Polymer of the Island Component and Polymer of the Sea Component)

The polymers used were the same as those used in Example 1.

(Spinning and Stretching)

The procedure of Example 1 was repeated except that the polymers of the sea component and the island component as described above were used, and 10.0% by weight of polyethylene glycol having a molecular weight of 20,000 was melt-blended. The resulting conjugated fiber had a single fiber fineness of 4.5 dtex, a crimp retention index of 5.0, and a shrinkage rate at 98° C. of 18.8%. This conjugated fiber was cut at a fiber length of 51 mm to obtain a staple fiber for an islands-in-the-sea conjugated fiber. When the cross-section of the conjugated fiber was observed with a TEM, the polyethylene glycol appeared as streaks extending in the longitudinal direction, and the maximum length was 112 μm. 10 or more buckled parts with the crack having a length of 15 μm or more were observed in the buckled parts formed by crimping.

<Nonwoven Fabric>

The staple fiber as described above was processed by repeating the procedure of Example 1 through the curding and cross lapping steps to form a laminated fiber web having a high rebounding property with the compression recovery rate of 88.0%. The resulting laminated fiber web was subjected to the needle punching to produce a nonwoven fabric having a weight per unit area of 794 g/m$^2$ and an apparent density of 0.270 g/cm$^3$. In the needle punching, the laminated fiber web experienced little change in the size in the machine direction, and the density could be increased. The elongation was well balanced, and the elongation ratio in machine and transverse directions was 0.95.

<Artificial Leather>

A base body for an artificial leather and an artificial leather were prepared by repeating the procedure of Example 1 except for the use of the nonwoven fabric as described above. The resulting artificial leather had good quality with high density. The weight loss by abrasion was 2.7 mg, and the surface quality was 4.5, both at favorable level. The results are shown in Tables 1 and 2.

Example 4

<Staple Fiber>

(Polymer of the Island Component and Polymer of the Sea Component)

The polymers used were the same as those used in Example 1.

(Spinning and Stretching)

The procedure of Example 1 was repeated except that the polymers of the sea component and the island component as described above were used, and 0.5% by weight of polyethylene glycol having a molecular weight of 20,000 was melt-blended. The resulting conjugated fiber had a single fiber fineness of 4.5 dtex, a crimp retention index of 3.6, and a shrinkage rate at 98° C. of 18.4%. This conjugated fiber was cut at a fiber length of 51 mm to obtain a staple fiber for an islands-in-the-sea conjugated fiber. When the cross-section of the conjugated fiber was observed with a TEM, the polyethylene glycol appeared as streaks extending in the longitudinal direction, and the maximum length was 18 μm. 10 or more buckled parts with the crack having a length of 15 μm or more were observed in the buckled parts formed by the crimping.

<Nonwoven Fabric>

The staple fiber as described above was processed by repeating the procedure of Example 1 through the curding and cross lapping steps to form a laminated fiber web having a high rebounding property with the compression recovery rate of 86.0%. The resulting laminated fiber web was subjected to the needle punching to produce a nonwoven fabric having a weight per unit area of 780 g/m$^2$ and an apparent density of 0.262 g/cm$^3$. In the needle punching, the laminated fiber web experienced little change in the size in the machine direction, and the density could be increased. The elongation was well balanced, and the elongation ratio in machine and transverse directions was 0.91.

<Artificial Leather>

A base body for an artificial leather and an artificial leather were prepared by repeating the procedure of Example 1 except for the use of the nonwoven fabric as described above. The resulting artificial leather had good quality. The weight loss by abrasion was 3.1 mg, and the surface quality was 4.0, both at favorable level. The results are shown in Tables 1 and 2.

Example 5

<Staple Fiber>

(Polymer of the Island Component and Polymer of the Sea Component)

The polymers used were the same as those used in Example 1.

(Spinning and Stretching)

The procedure of Example 1 was repeated except that the polymers of the sea component and the island component as described above were used, and the polyethylene glycol used had a molecular weight of 11,000. The resulting conjugated fiber had a single fiber fineness of 4.5 dtex, a crimp retention index of 5.1, and a shrinkage rate at 98° C. of 17.9%. This conjugated fiber was cut at a fiber length of 51 mm to obtain a staple fiber for an islands-in-the-sea conjugated fiber. When the cross-section of the conjugated fiber was observed with a TEM, the polyethylene glycol appeared as streaks extending in the longitudinal direction, and the maximum length was 23 μm. 10 or more buckled parts with the crack having a length of 15 μm or more were observed in the buckled parts formed by crimping.

<Nonwoven Fabric>

The staple fiber as described above was processed by repeating the procedure of Example 1 through the curding and cross lapping steps to form a laminated fiber web exhibiting a high rebounding property with the compression recovery rate of 87.8%. The resulting laminated fiber web was subjected to the needle punching to produce a nonwoven fabric having a weight per unit area of 801 g/m$^2$ and an apparent density of 0.270 g/cm$^3$. In the needle punching, the laminated fiber web experienced little change in the size in the machine direction, and the density could be increased. The elongation was well balanced, and the elongation ratio in machine and transverse directions was 0.94.

<Artificial Leather>

A base body for an artificial leather and an artificial leather were prepared by repeating the procedure of Example 1 except for the use of the nonwoven fabric as described above. The resulting artificial leather had good quality. The weight loss by abrasion was 3.3 mg, and the surface quality was 4.5, both at favorable level. The results are shown in Tables 1 and 2.

Example 6

<Staple Fiber>

(Polymer of the Island Component)

The polymer used was the same as the one used in Example 1.

(Polymer of the Sea Component)

A PET (Copolymerized PET 2) having 5% by mole of 5-sodium sulfoisophthalate copolymerized therewith having a melting point of 255° C. and a MFR of 95.0 was used for the polymer of the sea component.

(Spinning and Stretching)

The procedure of Example 1 was repeated except that the polymers of the sea component and the island component as described above were used. The resulting conjugated fiber had a single fiber fineness of 4.5 dtex, a crimp retention index of 5.5, and a shrinkage rate at 98° C. of 18.3%. This conjugated fiber was cut at a fiber length of 51 mm to obtain a staple fiber for an islands-in-the-sea conjugated fiber. When the cross-section of the conjugated fiber was observed with a TEM, the polyethylene glycol appeared as streaks extending in the longitudinal direction, and the maximum length was 25 μm. 10 or more buckled parts with the crack having a length of 15 μm or more were observed in the buckled parts formed by crimping.

<Nonwoven Fabric>

The staple fiber as described above was processed by repeating the procedure of Example 1 through the curding and cross lapping steps to form a laminated fiber web having a high rebounding property with the compression recovery rate of 88.5%. The resulting laminated fiber web was subjected to the needle punching to produce a nonwoven fabric having a weight per unit area of 803 g/m$^2$ and an apparent density of 0.271 g/cm$^3$. In the needle punching, the laminated fiber web experienced little change in the size in the machine direction, and the density could be increased. The elongation was well balanced, and the elongation ratio in machine and transverse directions was 0.95.

<Artificial Leather>

A base body for an artificial leather and an artificial leather were prepared by repeating the procedure of Example 1 except for the use of the nonwoven fabric as described above. The resulting artificial leather had good quality with high density. The weight loss by abrasion was 2.8 mg, and the surface quality was 4.5, both at favorable level. The results are shown in Tables 1 and 2.

Example 7

<Staple Fiber>

(Polymer of the Island Component)

A polypropylene terephthalate having a melting point of 230° C. and a MFR of 52.0 was used for the polymer of the island component.

(Polymer of the Sea Component)

The polymer used was the same as the one used in Example 1.

(Spinning and Stretching)

The procedure of Example 1 was repeated except that the polymers of the sea component and the island component as described above were used. The resulting conjugated fiber had a single fiber fineness of 4.5 dtex, a crimp retention index of 4.9, and a shrinkage rate at 98° C. of 18.9%. This conjugated fiber was cut at a fiber length of 51 mm to obtain a staple fiber for an islands-in-the-sea conjugated fiber. When the cross-section of the conjugated fiber was observed with a TEM, the polyethylene glycol appeared as streaks extending in the longitudinal direction, and the maximum length was 30 μm. 8 or more buckled parts with the crack having a length of 15 μm or more were observed in the buckled parts formed by crimping.

<Nonwoven Fabric>

The staple fiber as described above was processed by repeating the procedure of Example 1 through the curding and cross lapping steps to form a laminated fiber web having a high rebounding property with the compression recovery rate of 87.0%. The resulting laminated fiber web was subjected to the needle punching to produce a nonwoven fabric having a weight per unit area of 789 g/m$^2$ and an apparent density of 0.269 g/cm$^3$. In the needle punching, the laminated fiber web experienced little change in the size in the machine direction, and the density could be increased. The elongation was well balanced, and the elongation ratio in machine and transverse directions was 0.94.

<Artificial Leather>

A base body for an artificial leather and an artificial leather were prepared by repeating the procedure of Example 1 except for the use of the nonwoven fabric as described above. The resulting artificial leather had good quality with high density. The weight loss by abrasion was 3.0 mg, and the surface quality was 4.0, both at favorable level. The results are shown in Tables 1 and 2.

Example 8

<Staple Fiber>

(Polymer of the Island Component)

A nylon 6 having a melting point of 220° C. and a MFR of 58.5 was used for the polymer of the island component.

(Polymer of the Sea Component)

The polymer used was the same as the one used in Example 1.

(Spinning and Stretching)

The procedure of Example 1 was repeated except that the polymers of the sea component and the island component as described above were used. The resulting conjugated fiber had a single fiber fineness of 4.5 dtex, a crimp retention index of 5.2, and a shrinkage rate at 98° C. of 19.3%. This conjugated fiber was cut at a fiber length of 51 mm to obtain a staple fiber for an islands-in-the-sea conjugated fiber. When the cross-section of the conjugated fiber was observed with a TEM, the polyethylene glycol appeared as streaks extending in the longitudinal direction, and the maximum length was 28 μm. 8 or more buckled parts with the crack having a length of 15 μm or more were observed in the buckled parts formed by crimping.

<Nonwoven Fabric>

The staple fiber as described above was processed by repeating the procedure of Example 1 through the curding and cross lapping steps to form a laminated fiber web having a high rebounding property with the compression recovery rate of 86.2%. The resulting laminated fiber web was subjected to the needle punching to produce a nonwoven fabric having a weight per unit area of 802 g/m$^2$ and an apparent density of 0.272 g/cm$^3$. In the needle punching, the laminated fiber web experienced little change in the size in the machine direction, and the density could be increased. The elongation was well balanced, and the elongation ratio in machine and transverse directions was 0.96.

<Artificial Leather>

A base body for an artificial leather was prepared by repeating the procedure of Example 1 except for the use of the nonwoven fabric as described above. An artificial leather was prepared by dying the base body for an artificial leather with 4.0% owf of a gold-containing dye under the conditions including a temperature of 60° C., a bath ratio of 1:100, and a pH of 7 for 120 minutes. The resulting artificial leather had a good quality. The weight loss by abrasion was 3.7 mg, and the surface quality was 4.0, both at a good level. The results are shown in Tables 1 and 2.

Example 9

<Staple Fiber>

(Polymer of the Island Component and Polymer of the Sea Component)

The polymers used were the same as those used in Example 1.

(Spinning and Stretching)

The procedure of Example 1 was repeated except that the polymers of the sea component and the island component as described above were used, and the liquid bath temperature in the stretching step was 95° C. The resulting conjugated fiber had a single fiber fineness of 4.5 dtex, a crimp retention index of 4.0, and a shrinkage rate at 98° C. of 8.4%. This conjugated fiber was cut at a fiber length of 51 mm to obtain a staple fiber for an islands-in-the-sea conjugated fiber. When the cross-section of the conjugated fiber was observed with a TEM, the polyethylene glycol appeared as streaks extending in the longitudinal direction, and the maximum length was 28 μm. 5 or more buckled parts with the crack having a length of 15 μm or more were observed in the buckled parts formed by crimping.

<Nonwoven Fabric>

The staple fiber as described above was processed by repeating the procedure of Example 1 through the curding and cross lapping steps to form a laminated fiber web having a high rebounding property with the compression recovery rate of 87.4%. The resulting laminated fiber web was subjected to the needle punching to produce a nonwoven fabric having a weight per unit area of 803 g/m$^2$ and an apparent density of 0.274 g/cm$^3$. In the needle punching, the laminated fiber web experienced little change in the size in the machine direction, and the density could be increased. The elongation was well balanced, and the elongation ratio in machine and transverse directions was 0.94.

<Artificial Leather>

A base body for an artificial leather and an artificial leather were prepared by repeating the procedure of Example 1 except for the use of the nonwoven fabric as described above. The resulting artificial leather had insufficient quality with less dense texture due to the low shrinkage rate (8.4%) of the staple fiber. The weight loss by abrasion was 3.9 mg, and the surface quality was 3.5, both at favorable level. The results are shown in Tables 1 and 2.

Example 10

<Staple Fiber>

(Polymer of the Island Component and Polymer of the Sea Component)

The polymers used were the same as those used in Example 1.

(Spinning and Stretching)

The procedure of Example 1 was repeated except that the polymers of the sea component and the island component as described above were used, and a polyethylene glycol-polypropylene glycol copolymer having a molecular weight of 20,000 (NEWPOL PE-128 manufactured by Sanyo Chemical Industries, Ltd.) was used instead of the polyethylene glycol. The resulting conjugated fiber had a single fiber fineness of 4.5 dtex, a crimp retention index of 5.4, and a shrinkage rate at 98° C. of 19.5%. This conjugated fiber was cut at a fiber length of 51 mm to obtain a staple fiber for an islands-in-the-sea conjugated fiber. When the cross-section of the conjugated fiber was observed with a TEM, the polyethylene glycol appeared as streaks extending in the longitudinal direction, and the maximum length was 29 μm. 10 or more buckled parts with the crack having a length of 15 μm or more were observed in the buckled parts formed by crimping.

<Nonwoven Fabric>

The staple fiber as described above was processed by repeating the procedure of Example 1 through the curding and cross lapping steps to form a laminated fiber web having a high rebounding property with the compression recovery rate of 88.1%. The resulting laminated fiber web was subjected to the needle punching to produce a nonwoven fabric having a weight per unit area of 800 g/m$^2$ and an apparent density of 0.273 g/cm$^3$. In the needle punching, the laminated fiber web experienced little change in the size in the machine direction, and the density could be increased. The elongation was well balanced, and the elongation ratio in machine and transverse directions was 0.94.

<Artificial Leather>

A base body for an artificial leather and an artificial leather were prepared by repeating the procedure of Example 1 except for the use of the nonwoven fabric as described above. The resulting artificial leather had good quality with high density. The weight loss by abrasion was 2.7 mg, and the surface quality was 4.0, both at favorable level. The results are shown in Tables 1 and 2.

Example 11

<Staple Fiber>

(Polymer of the Island Component)

The polymer used was the same as the one used in Example 1.

(Polymer of the Sea Component)

The polymer used was the one prepared by adding (mixing) 2.0% by weight of the polyethylene glycol having a molecular weight of 20,000 used in the Example 1 in the course of the polymerization of the Copolymerized PET 1 used in Example 1 after the transesterification and after reacting 3 hours at 280° C. in vacuum and 30 minutes before the completion of the polymerization.

(Spinning and Stretching)

The procedure of Example 1 was repeated except that the polymers of the sea component and the island component as described above were used. The resulting conjugated fiber had a single fiber fineness of 4.5 dtex, a crimp retention index of 3.8, and a shrinkage rate at 98° C. of 18.2%. This conjugated fiber was cut at a fiber length of 51 mm to obtain a staple fiber for an islands-in-the-sea conjugated fiber. When the cross-section of the conjugated fiber was observed with a TEM, the polyethylene glycol appeared as streaks extending in the longitudinal direction, and the maximum length was 14 μm. 5 or more buckled parts with the crack having a length of 15 μm or more were observed in the buckled parts formed by crimping.

<Nonwoven Fabric>

The staple fiber as described above was processed by repeating the procedure of Example 1 through the curding and cross lapping steps to form a laminated fiber web having a high rebounding property with the compression recovery rate of 85.1%. The resulting laminated fiber web was subjected to the needle punching to produce a nonwoven fabric having a weight per unit area of 785 g/m$^2$ and an apparent density of 0.261 g/cm$^3$. In the needle punching, the laminated fiber web experienced little change in the size in the machine direction, and the density could be increased. The elongation was ill balanced compared to Example 1, and the elongation ratio in machine and transverse directions was 0.91.

<Artificial Leather>

A base body for an artificial leather and an artificial leather were prepared by repeating the procedure of Example 1 except for the use of the nonwoven fabric as described above. The resulting artificial leather had a good quality. The weight loss by abrasion was 3.8 mg, and the surface quality was 3.5. The results are shown in Tables 1 and 2.

Comparative Example 1

<Staple Fiber>

(Polymer of the Island Component and Polymer of the Sea Component)

The polymers used were the same as those used in Example 1.

(Spinning and Stretching)

The procedure of Example 1 was repeated except that the polymers of the sea component and the island component as described above were used, and the polyethylene glycol was not melt-blended. The resulting conjugated fiber had a single fiber fineness of 4.5 dtex, a crimp retention index of 2.7, and a shrinkage rate at 98° C. of 17.8%. This conjugated fiber was cut at a fiber length of 51 mm to obtain a staple fiber for an islands-in-the-sea conjugated fiber. When the cross-section of the conjugated fiber was observed with a TEM, the polyethylene glycol in the form of streaks extending in the longitudinal direction was not present, and cracks in the buckled parts formed by crimping was not observed.

<Nonwoven Fabric>

The staple fiber as described above was processed by repeating the procedure of Example 1 through the curding and cross lapping steps to form a laminated fiber web having a low rebounding property with the compression recovery rate of 83.5%. The resulting laminated fiber web was subjected to the needle punching to produce a nonwoven fabric having a weight per unit area of 773 g/m$^2$ and an apparent density of 0.254 g/cm$^3$. In the needle punching, the laminated fiber web experienced substantial elongation in the machine direction. The elongation was ill balanced, and the elongation ratio in machine and transverse directions was 0.82.

<Artificial Leather>

A base body for an artificial leather and an artificial leather were prepared by repeating the procedure of Example 1 except for the use of the nonwoven fabric as described above. The weight loss by abrasion was 4.3 mg, and the surface quality was 3.0, both at inferior level compared to Example 1. The results are shown in Table 1 (conjugated fiber) and Table 2 (fiber web, nonwoven fabric, and artificial leather).

Comparative Example 2

<Staple Fiber>

(Polymer of the Island Component)

The polymer used was the same as the one used in Example 1.

(Polymer of the Sea Component)

A PET (Copolymerized PET 3) having 4% by mole of 5-sodium sulfoisophthalate copolymerized therewith having a melting point of 255° C. and a MFR of 96.0 was used for the polymer of the sea component.

(Spinning and Stretching)

The procedure of Example 1 was repeated except that the polymers of the sea component and the island component as described above were used. The resulting conjugated fiber had a single fiber fineness of 4.5 dtex, a crimp retention index of 2.4, and a shrinkage rate at 98° C. of 19.3%. This conjugated fiber was cut at a fiber length of 51 mm to obtain a staple fiber for an islands-in-the-sea conjugated fiber. When the cross-section of the conjugated fiber was observed with a TEM, the polyethylene glycol appeared as streaks extending in the longitudinal direction, and the maximum length was 25 μm. However, buckled parts with the crack having a length of 15 μm or more were not observed since the 5-sodium sulfoisophthalate copolymerized was 4% by mole.

<Nonwoven Fabric>

The staple fiber as described above was processed by repeating the procedure of Example 1 through the curding and cross lapping steps to form a laminated fiber web having a low rebounding property with the compression recovery rate of 82.1%. The resulting laminated fiber web was subjected to the needle punching to produce a nonwoven fabric having a weight per unit area of 763 g/m$^2$ and an apparent density of 0.251 g/cm$^3$. In the needle punching, the laminated fiber web experienced substantial elongation in the machine direction. The elongation was ill balanced, and the elongation ratio in machine and transverse directions was 0.80.

<Artificial Leather>

A base body for an artificial leather and an artificial leather were prepared by repeating the procedure of Example 1 except for the use of the nonwoven fabric as described above. The weight loss by abrasion was 5.9 mg, and the surface quality was 3.0, both at inferior level compared to Example 1. The results are shown in Tables 1 and 2.

Comparative Example 3

<Staple Fiber>

(Polymer of the Island Component)

A PET (Copolymerized PET 1) having 8% by mole of 5-sodium sulfoisophthalate copolymerized therewith having a melting point of 240° C. and a MFR of 100 was used for the polymer of the sea component.

(Polymer of the Sea Component)

A PET having a melting point of 260° C. and a MFR of 46.5 was used for the polymer of the sea component.

(Spinning and Stretching)

The procedure of Example 1 was repeated except that the polymers of the sea component and the island component as described above were used, and the polymer of the island component (Copolymerized PET 1) had 2.0% by weight of the polyethylene glycol having a molecular weight of 20,000 melt-blended therein. The resulting conjugated fiber had a single fiber fineness of 4.5 dtex, a crimp retention index of 2.5, and a shrinkage rate at 98° C. of 17.6%. This conjugated fiber was cut at a fiber length of 51 mm to obtain a staple fiber for an islands-in-the-sea conjugated fiber. When the cross-section of the conjugated fiber was observed with a TEM, cracks were not observed in the buckled part formed by crimping since polyethylene glycol was absent in the sea component (PET).

<Nonwoven Fabric>

The staple fiber as described above was processed by repeating the procedure of Example 1 through the curding and cross lapping steps to form a laminated fiber web having a high rebounding property with the compression recovery rate of 83.0%. The resulting laminated fiber web was subjected to the needle punching to produce a nonwoven fabric having a weight per unit area of 765 g/m$^2$ and an apparent density of 0.250 g/cm$^3$. In the needle punching, the laminated fiber web experienced large elongation in the machine direction, and the elongation was ill balanced, and the elongation ratio in machine and transverse directions was 0.81.

<Artificial Leather>

A base body for an artificial leather and an artificial leather were prepared by repeating the procedure of Example 1 except for the use of the nonwoven fabric as described above. The weight loss by abrasion was 6.5 mg, and the surface quality was 2.0, both at inferior level compared to Example 1. The results are shown in Tables 1 and 2.

TABLE 1

| | Less readily soluble component (island) | Readily soluble component (sea) | Polyalkylene glycol: molecular weight | Amount added (wt %) | Length of PEG molecular chain (μm) | Cracks in the crimped part | Crimp retaining index | Shrinkage (%) |
|---|---|---|---|---|---|---|---|---|
| Example 1 | PET | Copolymerized PET 1 | PEG: 20,000 | 2.0 | 27 | Yes | 5.6 | 18.5 |
| Example 2 | PET | Copolymerized PET 1 | PEG: 20,000 | 5.0 | 59 | Yes | 6.1 | 19.1 |
| Example 3 | PET | Copolymerized PET 1 | PEG: 20,000 | 10 | 112 | Yes | 5.0 | 18.8 |
| Example 4 | PET | Copolymerized PET 1 | PEG: 20,000 | 0.5 | 18 | Yes | 3.6 | 18.4 |
| Example 5 | PET | Copolymerized PET 1 | PEG: 11,000 | 2.0 | 23 | Yes | 5.1 | 17.9 |
| Example 6 | PET | Copolymerized PET 2 | PEG: 20,000 | 2.0 | 25 | Yes | 5.5 | 18.3 |
| Example 7 | PPT | Copolymerized PET 1 | PEG: 20,000 | 2.0 | 30 | Yes | 4.9 | 18.9 |
| Example 8 | N6 | Copolymerized PET 1 | PEG: 20,000 | 2.0 | 28 | Yes | 5.2 | 19.3 |
| Example 9 | PET | Copolymerized PET 1 | PEG: 20,000 | 2.0 | 29 | Yes | 4.0 | 8.4 |
| Example 10 | PET | Copolymerized PET 1 | PEG/PPG: 20,000 | 2.0 | 34 | Yes | 5.4 | 19.5 |
| Example 11 | PET | Copolymerized PET 1 | PEG: 20,000*[1] | 2.0 | 14 | Yes | 3.8 | 18.2 |
| Comparative Example1 | PET | Copolymerized PET 1 | — | 0 | 0 | No | 2.7 | 17.8 |
| Comparative Example 2 | PET | Copolymerized PET 3 | PEG: 20,000 | 2.0 | 0 | No | 2.4 | 19.3 |
| Comparative Example 3 | Copolymerized PET 1 | PET | PEG: 20,000*[2] | 2.0 | 0 | No | 2.5 | 17.6 |

*added 30 minutes before the completion of the polymerization.

*[2]added to the less readily soluble component

TABLE 2

| | Compression recovery rate of the fiber web (%) | Apparent density of the nonwoven fabric | Elongation ratio in machine and transverse directions of the nonwoven fabric | Weight loss by abrasion (mg) | Quality of the product |
|---|---|---|---|---|---|
| Example 1 | 89.0 | 0.275 | 0.96 | 2.5 | 4.5 |
| Example 2 | 89.5 | 0.278 | 0.97 | 2.4 | 5.0 |
| Example 3 | 88.0 | 0.270 | 0.95 | 2.7 | 4.5 |
| Example 4 | 86.0 | 0.262 | 0.91 | 3.1 | 4.0 |
| Example 5 | 87.8 | 0.270 | 0.94 | 3.3 | 4.5 |

TABLE 2-continued

| | Compression recovery rate of the fiber web (%) | Apparent density of the nonwoven fabric | Elongation ratio in machine and transverse directions of the nonwoven fabric | Weight loss by abrasion (mg) | Quality of the product |
|---|---|---|---|---|---|
| Example 6 | 88.5 | 0.271 | 0.95 | 2.8 | 4.5 |
| Example 7 | 87.0 | 0.269 | 0.94 | 3.0 | 4.0 |
| Example 8 | 86.2 | 0.272 | 0.96 | 3.7 | 4.0 |
| Example 9 | 87.4 | 0.274 | 0.94 | 3.9 | 3.5 |
| Example 10 | 88.1 | 0.273 | 0.94 | 2.7 | 4.0 |
| Example 11 | 85.1 | 0.261 | 0.91 | 3.8 | 3.5 |
| Comparative Example 1 | 83.5 | 0.254 | 0.82 | 4.3 | 3.0 |
| Comparative Example 2 | 82.1 | 0.251 | 0.80 | 5.9 | 3.0 |
| Comparative Example 3 | 83.0 | 0.250 | 0.81 | 6.5 | 2.0 |

What is claimed is:

1. A conjugated fiber comprising a readily soluble polyester component and a less readily soluble polyester component wherein the readily soluble polyester component exhibits a solubility at least 100 times higher than the solubility of the less readily soluble polyester component in an alkaline aqueous solution, wherein the readily soluble polyester component comprises a copolymerized polyester having 5 to 10% by mole of 5-sodium sulfoisophthalate copolymerized therewith and the readily soluble polyester component contains a polyalkylene glycol, wherein the polyalkylene glycol is in the form of streaks extending in a longitudinal direction on the fiber in the longitudinal cross section of the conjugated fiber, wherein the polyalkylene glycol extending in the longitudinal direction of the fiber in the form of streaks has a length of at least 15 μm, and wherein the conjugated fiber has crimps, and a crimp retention index of the conjugated fiber is in the range of 4 to 10.

2. A conjugated fiber according to claim 1 wherein the polyalkylene glycol is blended in the copolymerized polyester.

3. A conjugated fiber according to claim 1 wherein the content of the polyalkylene glycol in the readily soluble polyester component is 1 to 10% by weight.

4. A conjugated fiber according to claim 1 wherein the polyalkylene glycol is polyethylene glycol.

5. A conjugated fiber according to claim 1 wherein a crack and/or crevice is present in the crimps.

6. A conjugated fiber according to claim 1 wherein shrinkage rate at 98° C. is in the range of 10 to 40%.

7. A base body for an artificial leather prepared by using a conjugated fiber according to claim 1.

8. An artificial leather prepared by using the base body for an artificial leather according to claim 7.

* * * * *